US006660334B2

(12) United States Patent
Takeuchi et al.

(10) Patent No.: US 6,660,334 B2
(45) Date of Patent: Dec. 9, 2003

(54) WATER-DECOMPOSABLE CLEANING ARTICLE AND MANUFACTURING METHOD THEREFOR

(75) Inventors: Naohito Takeuchi, Kagawa (JP); Konishi Takayoshi, Kagawa (JP)

(73) Assignee: Uni-Charm Corporation, Kawanoe (JP)

( * ) Notice: Subject to any disclaimer, the term of this patent is extended or adjusted under 35 U.S.C. 154(b) by 77 days.

(21) Appl. No.: 10/012,957

(22) Filed: Dec. 7, 2001

(65) Prior Publication Data

US 2002/0065011 A1 May 30, 2002

Related U.S. Application Data

(62) Division of application No. 09/550,690, filed on Apr. 17, 2000, now abandoned.

(30) Foreign Application Priority Data

Apr. 20, 1999 (JP) ..... 11-112772

(51) Int. Cl.[7] ..... B05D 3/02; B05D 3/12

(52) U.S. Cl. ..... 427/348; 427/381; 427/382; 427/384; 427/389.9

(58) Field of Search ..... 427/348, 379, 427/381, 382, 384, 389.9

(56) References Cited

U.S. PATENT DOCUMENTS 5,137,600 A * 8/1992 Barnes et al. ..... 162/115

FOREIGN PATENT DOCUMENTS

| | | | |
|---|---|---|---|
| EP | 0905313 A2 | | 3/1999 |
| GB | 1441690 | | 7/1976 |
| JP | 55148298 | | 11/1980 |
| JP | 61296159 | | 12/1986 |
| JP | 2-229295 | | 9/1990 |
| JP | 08013385 | | 1/1996 |
| JP | 9-228214 | | 9/1997 |
| JP | 11-047026 | * | 2/1999 |
| JP | 11-093055 | * | 4/1999 |
| WO | WO98/44181 | | 10/1998 |

OTHER PUBLICATIONS

European Search Report dated Aug. 8, 2000, for EP 1046747.

* cited by examiner

*Primary Examiner*—Erma Cameron
(74) *Attorney, Agent, or Firm*—Darby & Darby

(57) ABSTRACT

There is disclosed a cleaning article including a water-decomposable non-woven fabric containing water dispersible fibers and a water soluble resin coated on one side or both sides of the water-decomposable non-woven fabric. The water soluble resin is contained more in a surface portion or surface portions of a fiber assembly than in a remaining portion or inner portion of the fiber assembly. The water soluble resin thus contained can increase only the surface strength of the non-woven fabric sufficiently without deteriorating the softness of the entire article, so that dropping of fibers or breakage of surface upon wiping operation can be prevented.

3 Claims, 4 Drawing Sheets

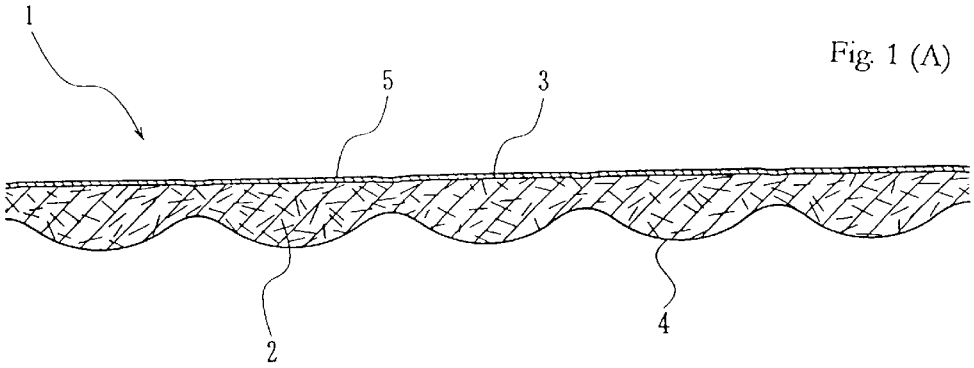
Fig. 1 (A)
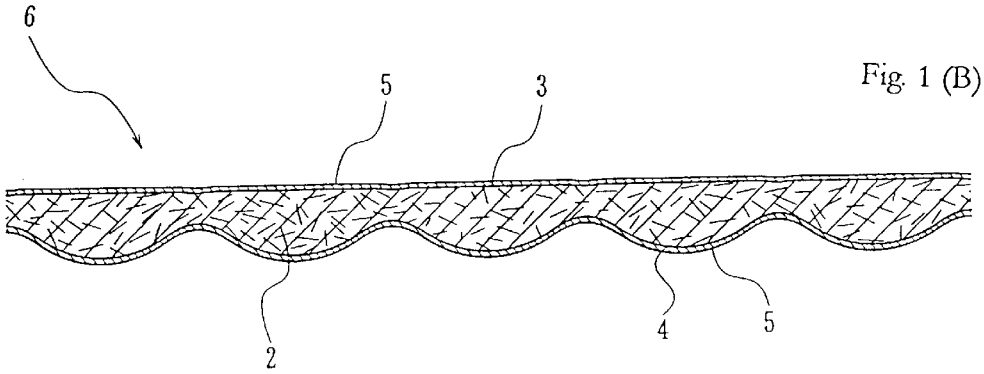
Fig. 1 (B)
Fig. 2
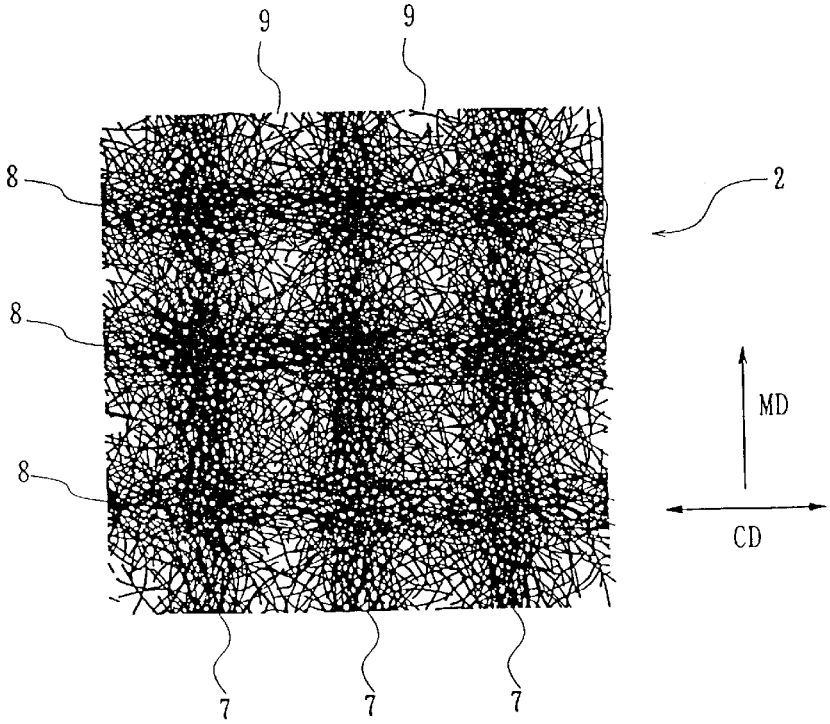

WATER-DECOMPOSABLE CLEANING ARTICLE AND MANUFACTURING METHOD THEREFOR

This is a division of application Ser. No. 09/550,690, filed Apr. 17, 2000. Now ABN Each of these prior applications is hereby incorporated herein by reference, in its entirety.

BACKGROUND OF THE INVENTION

1. Field of the Invention

The present invention concerns a cleaning article using a water-decomposable non-woven fabric which is dispersed easily by a water stream and, more in particular, it relates to a cleaning article of low density and having high surface strength.

2. Related Art

Cleaning articles formed with water-decomposable non-woven fabrics are used for the cleaning operation of wiping human skins such as on hips or for cleaning toilets and thereabouts. The cleaning articles can be directly flushed away in toilets after use.

Japanese Patent Laid-Open No. 229295/1990 discloses a water-decomposable non-woven fabric used for cleaning articles of this kind in which a non-woven fabric formed of water dispersible fibers contains carboxymethyl cellulose (CMC) as a water soluble binder and also contains a polyvalent metal salt for preventing dissolution of the water soluble binder in a wet state thereby improving the wet strength.

Further, Japanese Patent Laid-Open No. 228214/1997 discloses a product prepared by entangling under a water stream regenerated cellulose fibers having a fiber length of 4 mm to 20 mm and pulp fibers by a water jetting treatment, which intends to establish a balance between the strength and the water decomposability of the non-woven fabric by selecting the fiber length of the regenerated cellulose fibers.

In Japanese Patent Laid-Open No. 229295/1990 the water soluble binder is impregnated into the entire non-woven fabric formed of the water dispersible fibers to improve the strength of the non-woven fabric in the wet state. However, in the fabrics of this type, since the water soluble binder is impregnated into the non-woven fabric generally by using a spray, while the tensile strength of the entire non-woven fabric can be increased to some extent, the strength at the surface of the non-woven fabric can not be improved sufficiently.

Accordingly, fluffing often occurs on the surface of the non-woven fabric during wiping of dirt, or the surface of the non-woven fabric is often broken upon wiping of firmly deposited dirt.

Further, when the surface strength is intended to be improved by increasing the strength for the entire non-woven fabric, the amount of the binder to be impregnated into the non-woven fabric has to be increased. However, when the water soluble binder is impregnated by spraying into the non-woven fabric, there is a limit for the amount of the binder that can be impregnated into the non-woven fabric. Further, for impregnating a great amount of the water soluble binder into the non-woven fabric and improving the wet strength, it is necessary to incorporate a great amount of a metal salt in a wet state to bring about a problem in view of safety to human skins.

Then, in Japanese Patent Laid-Open No. 228214/1997, it is intended to improve the strength and make the water decomposability favorable by selecting the fiber length of the regenerated cellulose fibers. However, it is actually difficult to appropriately make a balance between the strength and the water decomposability. Moreover, since the entire strength is intended to be obtained merely by the entangled state of the fibers, the surface strength of the non-woven fabric is extremely low and the non-woven fabric involves a problem that the fibers appearing on the surface drop off during wiping operation or the surface of the non-woven fabric is broken easily.

SUMMARY OF THE INVENTION

The present invention intends to overcome the foregoing problems in the prior art and it is an object thereof to provide a cleaning article by using a non-woven fabric of satisfactory water decomposability, in which the surface strength of the non-woven fabric is increased thereby enabling to prevent fluffing on the surface and dropping of fibers upon wiping operation and, further, prevent breakage on the surface, as well as a manufacturing method thereof In accordance with the present invention, the foregoing object can be attained by a cleaning article comprising a water-decomposable non-woven fabric containing water dispersible fibers and a water soluble resin coated on at least one side of the water-decomposable non-woven fabric, in which the water soluble resin is contained more in a surface portion of a fiber assembly than in a remaining portion of the fiber assembly.

Here, when the water soluble resin is coated on both sides of the non-woven fabric, the remaining portion of the fiber assembly, as sandwiched between two surface portions, may be called "inner portion" or "intermediate portion". For convenience in illustrating the invention, therefore, the term "inner portion" is used hereinafter for describing the remaining portion, it being understood that the term "inner portion" never intends to limit the invention to the case where the water soluble resin is coated on both sides of the non-woven fabric.

The cleaning article of the invention can be produced, for example, by coating the water soluble resin on one side or both sides of the water-decomposable non-woven fabric in the state of a solution with a viscosity ranging from 1,000 cps to 100,000 cps.

In this case, the solution of the water soluble resin (for example, which is prepared by dissolving the water soluble resin in water or purified water) has such a high viscosity that it adheres mainly to the surface portion (surface layer), on one side or on each side of the non-woven fabric, without being impregnated uniformly into the non-woven fabric. Accordingly, in a state where the fiber web of the water decomposable non-woven fabric is dried, the amount of the water soluble resin adhered (or deposited) to the fibers is greater in the surface portion (surface layer) of the non-woven fabric than in the inner portion thereof.

Preferred range of the viscosity is from 5,000 cps to 70,000 cps and, further preferably, from 10,000 cps to 70,000 cps.

When the viscosity of the solution of the water soluble resin is less than 1,000 cps, the solution is impregnated almost uniformly into the non-woven fabric so that the water soluble resin can not be deposited sufficiently on the fibers of the surface layer. But, too much addition of the water soluble resin is undesirable. In this case, therefore, it is difficult to improve the surface strength of the non-woven fabric to a desired degree. When the viscosity is from 1,000 to less than 5,000 or 10,000 cps, the uniform impregnation of the solution can be prevented but it is still relatively difficult to permit only the surface layer to have a sufficient strength.

On the other hand, if the viscosity exceeds 100,000 cps, it is difficult to coat the solution uniformly on the surface of the non-woven fabric due to such a high viscosity. When it is 70,000 cps or less, the solution can be coated uniformly with no problem.

As described above, when the solution of the water soluble resin at a high viscosity is coated on the surface of the water-decomposable non-woven fabric and the amount of the water soluble resin in the surface layer is more than that in the inner portion, only the surface strength of the cleaning article can be improved satisfactorily. This enables prevention of fluffing on the surface, dropping of fibers and breakage at the surface upon wiping, and it also enables readily wiping of firmly deposited dirt.

The fiber density of the water-decomposable non-woven fabric is preferably 0.3 g/cm$^3$ or less.

In such a relatively bulky non-woven fabric having a low fiber density, a water soluble resin easily intrudes between fibers. Therefore, if a solution of a water soluble resin at a low viscosity is added by use of a spray as in the prior art, the water soluble resin comes into the inner portion of the non-woven fabric, so that it is difficult to improve only the surface strength of the non-woven fabric. In the invention, on the other hand, because the solution of the water soluble resin at a relatively high viscosity is coated on the surface, on one side or each side of the non-woven fabric, the water soluble resin can be maintained in the surface layer of the non-woven fabric to a desired degree. As a result, according to the invention, even in such a bulky non-woven fabric having a low fiber density, the surface strength can be improved. That is, the invention is suitable for a cleaning article comprising such a relatively bulky non-woven fabric having a low fiber density.

The average fiber length of fibers constituting the water-decomposable non-woven fabric is preferably 10 mm or less and, more preferably, 7 mm or less.

By the use of the fibers having such a short fiber length for the non-woven fabric, when the cleaning article is flushed in a flushing toilet, the fibers are easily dispersible, thereby improving the water decomposability of the cleaning article. In addition, since the surface strength of the non-woven fabric is improved by the water soluble resin, these short fibers is prevented from dropping off from the surface of the non-woven fabric.

The amount of coating of the water soluble resin is preferably from 0.5 g to 30 g based on 100 g of the fibers forming the water-decomposable non-woven fabric. Here, the coating amount of the water soluble resin is measured after drying the solution. If the coating amount is less than the lower limit described above, the surface strength of the non-woven fabric can not be improved sufficiently. On the other hand, when the coating amount exceeds the upper limit, the softness of the non-woven fabric is decreased.

The cleaning article of the invention preferably has such a softness in a dry state that the B value (which indicates the bending rigidity) of the cleaning article in a dry state as measured according to a KES bending test is from 0.05 or more to 1.0 or less. In the invention, used is the bulky non-woven fabric of a low density and therefore, the rigidity is not excessive and the softness is excellent. In addition, even for such bulky non-woven fabric of a low density, because the solution of the water soluble resin at a high viscosity is coated on the surface of the non-woven fabric thereby forming the water soluble resin-containing surface layer, the rigidity (B value) of 0.05 or more as described above can be attained.

When the cleaning article of the invention is prepared for use in a wet (moistened) state, an insolubilizing agent for the water soluble resin is preferably added. This can maintain the wet (moistened) strength of the cleaning article at a high level. However, the cleaning article of the invention may be used in a dry state as it is.

In such a wet state, the cleaning article of the invention preferably has such a softness that the B value (which indicates the bending rigidity) of the cleaning article in a wet state as measured according to a KES bending test is 0.03 or more. In this case, the upper limit is preferably 0.1 or less.

Further, when the water soluble resin is coated only on one side, it is preferred that the water soluble resin is coated on a surface of the water-decomposable non-woven fabric to be contacted by a drying drum for drying the water-decomposable non-woven fabric in a manufacturing process thereof. Because the surface becomes relatively smooth after in contact with the drying drum, the solution of the water soluble resin, when coated, less intrudes into the non-woven fabric.

In the cleaning article of the invention, the water soluble resin is coated on a surface to be used as a cleaning surface.

The present invention also provides a method of manufacturing a cleaning article comprising:

- a step of subjecting a fiber web containing water dispersible fibers to a water jetting treatment thereby forming a water-decomposable non-woven fabric,
- a step of drying the water-decomposable non-woven fabric after the water jetting treatment,
- a step of coating a solution of a water soluble resin with a viscosity ranging from 1,000 cps to 100,000 cps (preferably, 5,000 cps to 70,000 cps, and more preferably, 10,000 cps to 70,000 cps) on at least one side of the water-decomposable non-woven fabric after drying, and
- a step of drying the coated solution of the water soluble resin.

In the method described above, it is preferred that the water-decomposable non-woven fabric after the water jetting treatment is dried by using a drying drum, and the solution of the water soluble resin is coated to the water-decomposable non-woven fabric after drying on a surface contacted by the drying drum.

BRIEF DESCRIPTION OF THE ACCOMPANYING DRAWINGS

FIG. 1(A) is an enlarged fragmentary cross sectional view of a cleaning article of the invention in which a water soluble resin is coated on one side of a water-decomposable non-woven fabric;

FIG. 1(B) is an enlarged fragmentary cross sectional view of a cleaning article of the invention in which a water soluble resin is coated on both sides of a water-decomposable non-woven fabric;

FIG. 2 is an enlarged fragmentary plan view showing a water-decomposable non-woven fabric constituting the cleaning article of the invention;

DESCRIPTION OF THE PREFERRED EMBODIMENTS

Figure 3:
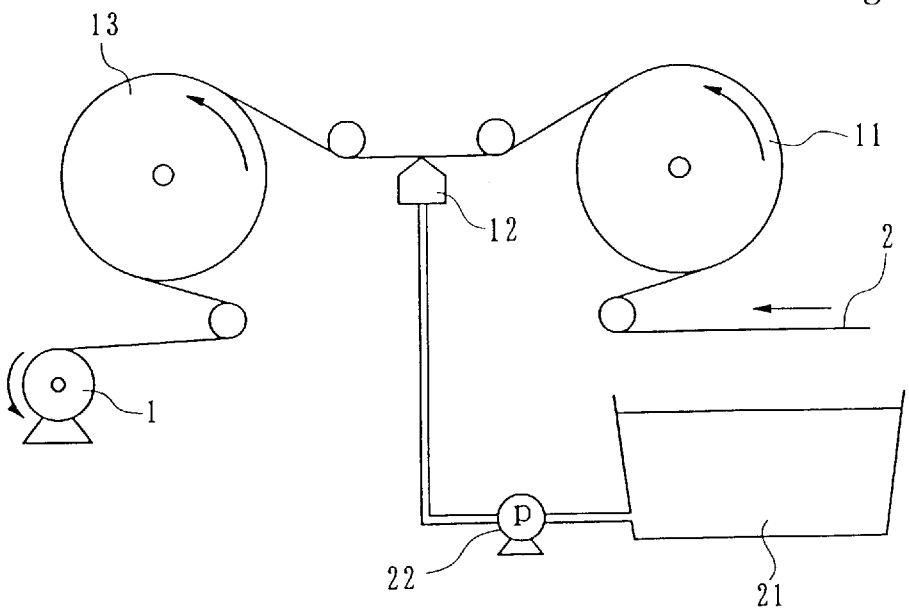
FIG. 3 is an explanatory view showing one example of a step for coating a water soluble resin on one side of a water-decomposable non-woven fabric.

FIG. 1(A) is an enlarged fragmentary cross sectional view of a cleaning article in which a water soluble resin is coated on one side of a water-decomposable non-woven fabric and FIG. 1(B) is an enlarged fragmentary cross sectional view of a cleaning article in which a water soluble resin is coated on both sides of a water-decomposable non-woven fabric.

In a cleaning article 1 shown in FIG. 1(A), a water soluble resin is coated by use of a coater on one surface 3 of a water-decomposable non-woven fabric 2, which is formed by subjecting a fiber web of water dispersible fibers to a water jetting treatment so that the fibers are entangled under a water stream to some extent. As a result, there is formed a surface layer 5 of fibers adhered with the water soluble resin on their surfaces (hereinafter, referred to as water soluble resin layer 5) as shown in FIG. 1(A). Here, the surface 3 to be coated is a surface subjected to the water jetting and contacted with a drying drum after the water jetting and therefore, it is relatively flat compared with another surface 4.

The strength of the relatively flat surface 3 is improved by the water soluble resin. When the surface 3 is used as a cleaning surface, therefore, dropping or fluffing of fibers less occurs or the surface is less broken during wiping.

In a cleaning article 6 shown in FIG. 1(B), the same water-decomposable non-woven fabric 2 as that shown in FIG. 1(A) is used, but the water soluble resin is coated by use of a coater on both surfaces 3 and 4 of the non-woven fabric 2 to form water soluble resin layers 5 and 5.

In the cleaning article 6 shown in FIG. 1(B), the surface strength is improved on both surfaces 3 and 4 of the water-decomposable non-woven fabric 2 with the water soluble resin layers 5 and 5. Therefore, both surfaces of the cleaning article 6 are suitable for use as cleaning surfaces.

FIG. 2 is an enlarged fragmentary plan view of the water-decomposable non-woven fabric 2.

As shown in FIG. 2, the water-decomposable non-woven fabric 2 prepared by subjecting a fiber web to a water jetting treatment includes a fiber assembly 7 of a high fiber density extending in the machine direction (MD), a fiber assembly 8 of a high fiber density extending in the cross direction (CD) perpendicular to MD and a region 9 of a low fiber density surrounded with the assembly 7 and the assembly 8. The formation of the assemblies 7 and 8 and the region 9 may be controlled by adjusting water jetting pressure or the like. The region 9 is an area from which many fibers are removed by water jetting. The water-decomposable non-woven fabric 2 is made relatively bulky to have a density (average density of the entire non-woven fabric) of 0.3 $g/cm^3$ or less.

At least in the fiber assembly 7, the water soluble resin coated is present in a greater amount in the surface portion than in the inner portion. In the fiber assembly 8, also, it is preferred that the water soluble resin coated is present in a greater amount in the surface portion than in the inner portion. However, in the region 9 of a low fiber density, the water soluble resin may be impregnated relatively uniformly.

As described above, since the water soluble resin is present more in the surface portion (surface layer) than in the inner portion, at least in the fiber assembly 7, the surface strength can be improved on the surface 3 or on both the surfaces 3 and 4 of the water-decomposable non-woven fabric 2.

The non-woven fabric 2 which is bulky and shaped as shown in FIG. 2 is easily decomposable in water since the strength at break upon wet state of the non-woven fabric is less than 100 g/25 mm (strength at break before formation of the water soluble resin layer 5). However, since the water soluble resin layer 5 is present on the surface 3 or on the surfaces 3 and 4 as described above, the strength (wet strength) upon wiping operation can be increased in a state where the water soluble resin of the layer 5 is not dissolved with water.

Further, in the cleaning article 1 or 6 of the invention, the surface strength is reinforced with the water soluble resin layer 5 but the non-woven fabric 2 itself is soft because the entire non-woven fabric 2 is of low density and bulky. Therefore, cleaning article 1 or 6 of the invention is bulky and has a soft feeling.

The softness of the cleaning article 1 or 6 of the invention in a dry state is preferably such that the B value measured according to the KES bending test (bending rigidity) is 0.05 or more and 1.0 or less. When the solution of the water soluble resin at a high viscosity is coated on the surface of the non-woven fabric, the rigidity of 0.05 or more as described above can be obtained even for the bulky non-woven fabric of low density, and the entire portion is soft.

Further, for the softness in the wet state, it is preferred that the B value as measured according the KES bending test (bending rigidity) is 0.03 or more and 0.1 or less.

Further, the amount of coating the water soluble resin (in a dried state) is preferably from 0.5 g to 30 g based on 100 g of the fibers of the water-decomposable non-woven fabric. If the coating amount is less than the lower limit, the surface strength of the non-woven fabric can not be improved. On the contrary, if the amount exceeds the upper limit, the softness of the non-woven fabric is deteriorated.

Fibers used for constituting the water-decomposable non-woven fabric 2 for the cleaning article 1 or 6 according to the invention are those having high water dispersibility (i.e., water dispersible fibers). The water dispersibility referred to herein has the same meaning as the water decomposability, which is a property of being divided finely in contact with a great amount of water (fibers are disintegrated from each other). A cleaning article prepared by manufacturing a non-woven fabric using such fibers and, further, coating the water soluble resin on the surface has a high strength, particularly, on the surface upon wiping operation and, when the article is in contact with a great amount of water, the water soluble resin as a binder is dissolved to disengage the bonds between the fibers so that the fibers are disintegrated from each other.

In the invention, chemical fibers and/or natural fibers can be used. The chemical fibers include, for example, regenerated fibers of rayon, acetate, etc.; synthetic fibers of polypropylene, etc. The natural fibers include, for example, those from wood pulp such as soft wood pulp, hard wood pulp, etc.; and also those from Manila hemp, linter pulp, bamboo pulp, kenafu, etc. Further, the fibers mentioned above may be used as the main ingredient while being incorporated with other fibers such as natural fibers from cotton, etc; synthetic fibers of polypropylene, polyvinyl alcohol, polyester, polyacrylonitrile, nylon, etc; synthetic pulp of polyethylene, etc; inorganic fibers; etc.

Among the fibers described above, preferred is rayon as regenerated fibers. Rayon is well dispersible in water and is also biodegradable.

In this case, it is further preferred that soft wood pulp as natural fibers is blended with rayon. This is because soft wood pulp has excellent water dispersibility. The average fiber length of the soft wood pulp is as short as from 1.0 mm to 4.5 mm and therefore, the soft wood pulp functions as a disintegrating agent in contact with a great amount of water so that the water-decomposable non-woven fabric can be easily disintegrated. The pulp preferably has CSF (measured value by Canadian Standard Freeness: JIS P 8121) of from 400 cc to 750 cc. When pulp with CFS of less than 400 cc, that is, highly beaten pulp is used, feeling of the non-woven fabric is worsened. It is more preferably from 500 cc to 750 cc. Further, as the soft wood pulp, bleached soft wood kraft pulp is generally used.

It is preferred that the fiber length of fibers such as rayon and natural fiber constituting the fiber web is preferably 10 mm or less. When the fiber length is 10 mm or less, the fibers are not entangled much to increase no entangled portions of fibers or the fibers are entangled properly upon applying the water jetting treatment to the fiber web, so that the water decomposability is improved. There is no particular restriction for the lower limit of the fiber length, but further shorter fiber length may also be adopted so long as the fibrous sheet can be formed. That is, in the water-decomposable non-woven fabric constituting the cleaning article of the invention, the average fiber length for each of different fibers is preferably 10 mm or less and, more preferably, 7 mm or less.

Even in a case of forming the water-decomposable non-woven fabric with fibers of such a short fiber length, dropping of the fibers at the surface can be prevented because the surface of the non-woven fabric is formed with the water soluble resin layer 5.

The water-decomposable non-woven fabric 2 constituting the cleaning article of the invention preferably has a basis weight (this may be referred to as "METSUKE") for the fibers of from 20 to 100 g/m$^2$. If the basis weight is less than the lower limit, no required strength as the cleaning article can be obtained. If the basis weight is more than the upper limit, the softness is poor and the fibers are less dispersible in water to deteriorate the water decomposability. In the cleaning article of the invention, the more preferred basis weight for the fibers is from 30 to 80 g/m$^2$ in view of the strength of the sheet, dirt wiping effect and soft feeling upon touching.

Any of water soluble polymers having a binder effect of securing fibers to each other may be used for the water soluble resin. A water soluble polymer having a biodegradability is preferable while considering flushing of the cleaning article into a flushing toilet. The water soluble polymer described above is coated in a state being dissolved in water to the non-woven fabric 2. Examples of the water soluble polymer include a natural polymer, a semi-synthetic polymer and a synthetic polymer As the natural polymer, one or two or more materials selected from locust bean gum, gum arabic, starch, gelatin, casein and guar gum can be used.

As the semi-synthetic polymer, one or two or more materials selected from alkyl cellulose, hydroxyethyl cellulose, carboxymethyl cellulose, ethylhydroxyethyl cellulose, methylhydroxypropyl cellulose, soluble starch, carboxymethyl starch, alginate and methyl starch can be used. The alkyl cellulose is a compound in which hydroxyl groups in the cyclic glucose unit of cellulose are substituted with alkyl groups. The alkyl cellulose can include, for example, methyl cellulose, ethyl cellulose and benzyl cellulose. Among them, methyl cellulose is particularly preferred in view of the good water decomposability and the strength.

As the synthetic polymer, polyvinyl alcohol and/or modified polyvinyl alcohol can be used. The modified polyvinyl alcohol is a vinyl alcoholic polymer containing a predetermined amount of sulfonic groups or carboxyl groups.

In addition, copolymers of polymerizable acid anhydride compounds with other compounds can also be used for improving the effect of the water soluble polymer. They may also be used as the water soluble resin having substantially the same function as the water soluble polymer. For example, they include compounds obtained by copolymerization of maleic anhydride or fumaric anhydride as the acid anhydride, with methyl methacrylate, methyl acrylate, ethyl acrylate, ethyl methacrylate or butyl methacrylate. In the case where the cleaning article is used directly to human skins, for example, the copolymer is preferably selected from (meth)acrylic acid-maleic acid resin, (meth)acrylic acid-fumaric acid resin, vinyl acetate-maleic acid resin, rosin modified fumaric acid resin, methyl vinyl ether-maleic acid resin, α-olefin-maleic acid resin, α-olefin fumaric acid resin, isobutylene maleic acid resin and pentene-maleic acid resin. In the case where the cleaning article is not used directly to human skins, other copolymers, for example, urea formalin resin, resins containing hydroxyl groups such as methylol melamine resin, organic compounds having two or more hydroxyl groups such as glyoxal or tunnic acid and epoxy polyamide series resins can be used. Among the copolymers, (meth)acrylic acid (ester) maleic acid copolymer and/or (meth)acrylic acid (ester) fumaric acid copolymer are preferred since they are highly safe and improve the wet strength of the cleaning article. These copolymers are preferably used after partially saponifying them under the effect of an alkali metal hydroxide such as sodium hydroxide or potassium hydroxide into sodium carboxylates. The degree of saponification is preferably from 0.1 to 1.0. Since adjacent carboxylic acid groups are formed into salts, partially saponified copolymers are more water soluble. They are preferably used together with the aforementioned water soluble polymer such as alkyl cellulose.

The water soluble resin or the water soluble resin and the copolymer of the polymerizable acid anhydride compound with other compound are dissolved into an aqueous solution such that the viscosity is at 1,000 cps to 100,000 cps (preferably, 5,000 cps to 70,000 cps, more preferably, 10,000 cps to 70,000 cps), and the solution is coated on the surface 3 of the water-decomposable non-woven fabric 2. The viscosity changes depending on the concentration contained in the aqueous solution.

The water-decomposable non-woven fabric 2 which is coated with the solution of the water soluble resin on the surface and then dried preferably has a strength of 250 g/25 mm or more for both MD and CD when it subsequently contains water to a wet state. That is, the cleaning article of the invention preferably has a wet strength of 250 g/25 mm or more for both MD and CD. However, even when the non-woven fabric has a wet strength lower than the aimed wet strength, the wet strength of the non-woven fabric can be increased by further incorporating an electrolyte as an insolubilizing agent.

For the electrolyte as the insolubilizing agent, either one or both of an organic salt and an inorganic salt can be used. The inorganic salt includes, for example, sodium sulfate, potassium sulfate, zinc sulfate, zinc nitrate, potassium alum, sodium chloride, aluminium sulfate, magnesium sulfate, potassium chloride, sodium carbonate, sodium hydrogencarbonate, ammonium carbonate, etc.; and the organic salt includes, for example, sodium pyrrolidone-carboxylate, sodium citrate, potassium citrate, sodium tartrate, potassium tartrate, sodium lactate, sodium succinate, calcium pantothenate, calcium lactate, sodium laurylsulfate, etc. When carbxymethyl cellulose is used as the water soluble resin, a bivalent salt is preferred for improving the strength of the water-decomposable non-woven fabric. On the other hand, when alkyl cellulose is used for the water soluble resin, a monovalent salt is preferred. When polyvinyl alcohol or modified polyvinyl alcohol is used as the water soluble resin, a monovalent salt is also preferable for use.

The electrolyte may be added to the water-decomposable non-woven fabric such that the electrolyte is dissolved into water and the aqueous solution is then impregnated into the non-woven fabric. Accordingly, the electrolyte is preferably water soluble. In this case, the concentration of the electrolyte in the aqueous solution to be impregnated into the water-decomposable non-woven fabric 2 is preferably from 0.5% to 10% by weight. It is more preferably from 1.0% to 5.0% by weight. The aqueous solution containing the electrolyte dissolved therein is impregnated, preferably, by 200 g to 350 g based on 100 g of the water-decomposable non-woven fabric. As the content of the electrolyte increases, the strength of the water-decomposable non-woven fabric increases. The aqueous solution can be impregnated into the water-decomposable non-woven fabric by a method of immersion or spraying.

Further, in a case of coating the aforementioned copolymer of the polymerizable acid anhydride compound with other compound, an amino acid derivative is preferably incorporated. The amino acid derivative is dissolved in water together with the electrolyte and impregnated into the water-decomposable non-woven fabric. The amino acid derivative is a compound produced from an amino acid, by subjecting the amino acid to acylation, dehydration and condensation, esterification, neutralization of fatty acid, or polymerization. For example, the amino acid derivative includes trimethyl glycine as an N-trialkyl-substituted glutamic acid; DL-pyrrolidone carboxylic acid, DL-pyrrolidone sodium carboxylate, and DL-pyrrolidone carboxylate triethanolamine, which are produced by subjecting glutamic acid to dehydration and condensation; N-coconut oil fatty acid acyl L-arginine ethyl DL-pyrrolidone carbonic acid produced by acylation and esterification of arginine, and poly(sodium aspartate) produced by polymerizing aspartic acid. Among them, trimethyl glycine is particularly preferable because of its great safety profile and the increased wet strength of the resulting cleaning article.

As described above, according to the invention, a water-decomposable non-woven fabric having a wet strength (MD or CD) of 250 g/25 mm or more can be obtained by coating the water soluble resin on the surface of the non-woven fabric and incorporating the electrolyte.

Further, the degree of water decomposability of the resulting water-decomposable non-woven fabric is preferably 120 sec or less and, more preferably, 100 sec or less.

Figure 4:
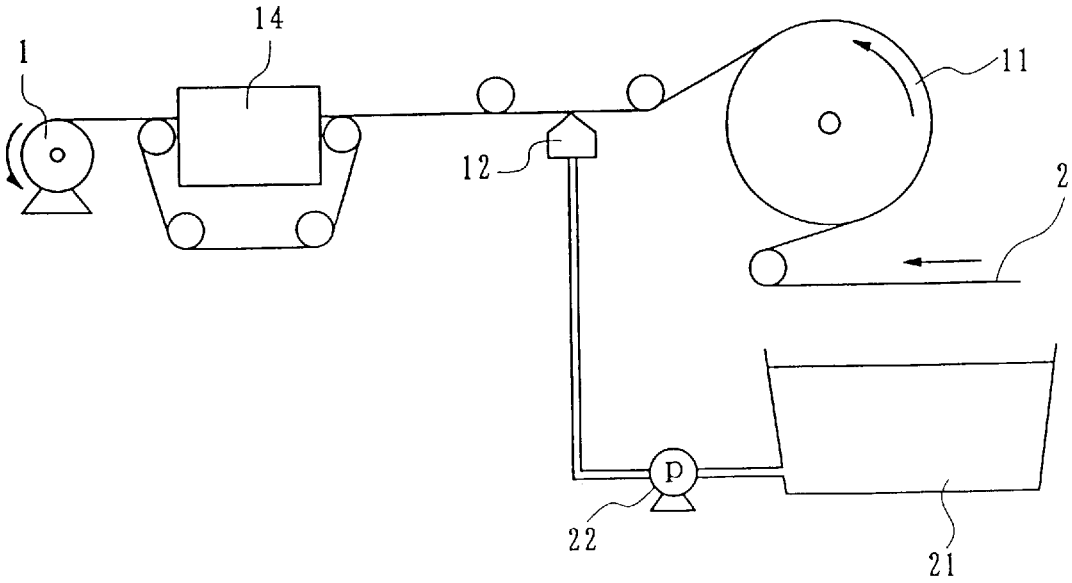
FIG. 4 is an explanatory view showing another example of a step for coating a water soluble resin on one side of a water-decomposable non-woven fabric.

FIG. 3 and FIG. 4 are explanatory views, each showing a production process of the cleaning article 1 of FIG. 1(A) in which the water soluble resin is coated only on one side.

In the process shown in FIG. 3, the water-decomposable non-woven fabric 2 formed by a water jetting treatment is dried by a drying drum 11 after the water jetting treatment. The non-woven fabric 2 is brought into contact, at the surface thereof applied with the water jetting, with the drying drum 11 and dried. After the drying step by the drying drum 11, a coater 12 is brought into contact with the surface of the water-decomposable non-woven fabric 2 that was in contact with the drying drum 11. The coater 12 has a slit formed on its surface and the solution of the water soluble resin is delivered from a tank 21 by way of a pump 22 and then coated by the coater 12 to the surface (i.e., surface 3 in FIG. 1(A)), on one side of the water-decomposable non-woven fabric 2.

The water-decomposable non-woven fabric 2 coated with the solution of the water soluble resin is then brought into contact, at the coated surface thereof, with a drying drum 13, and the solution of the water soluble resin is dried and then the dried product is taken up as the cleaning article 1 of the invention in which the water soluble resin layer (i.e., water soluble resin layer 5 in FIG. 1(A)) is formed as a surface layer.

In the process shown in FIG. 4, the water-decomposable non-woven fabric 2 formed by the water jetting treatment is dried by the drying drum 11, coated with the solution of the water soluble resin on one side by the coater 12 and then supplied to a hot blow drier 14, in which the water soluble resin is dried and then the dried product is taken up as the cleaning article 1 of the invention.

Figure 5:
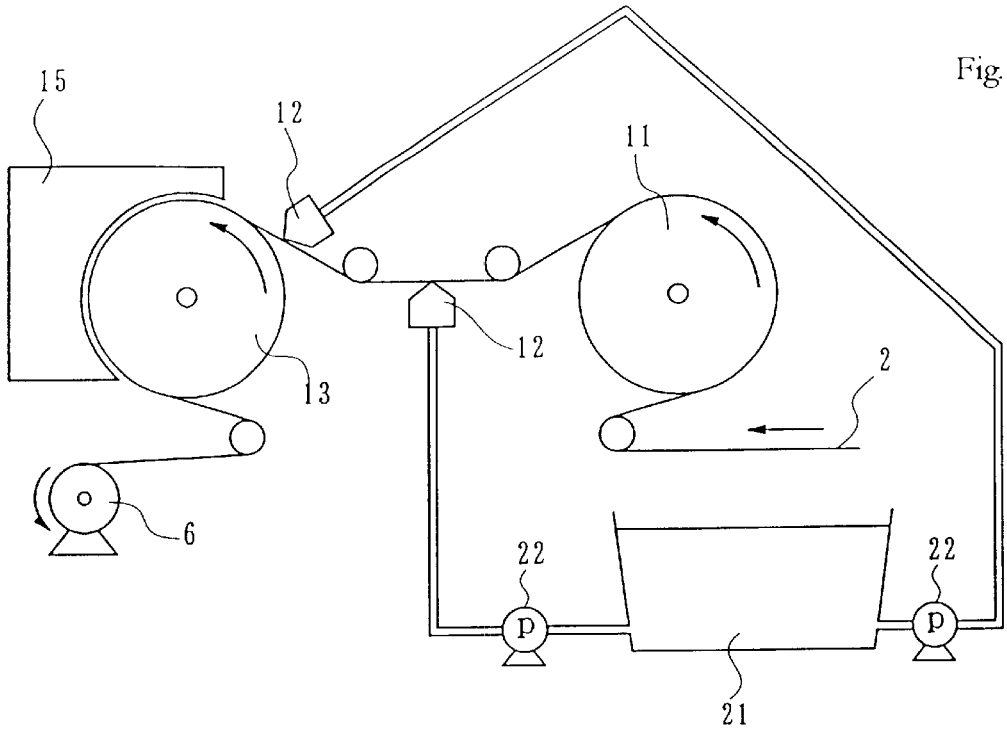
FIG. 5 is an explanatory view showing one example of a step for coating a water soluble resin on both sides of a water-decomposable non-woven fabric.
Figure 6:
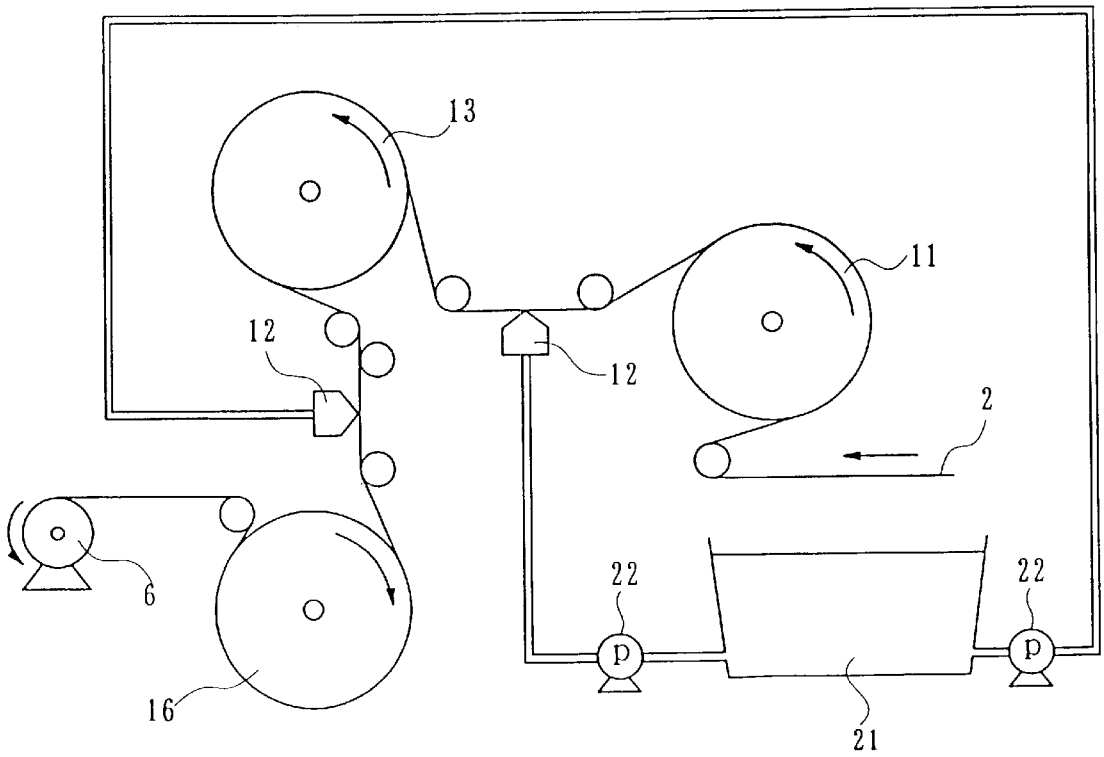
FIG. 6 is an explanatory view showing another example of a step for coating a water soluble resin on both sides of a water-decomposable non-woven fabric.
Figure 7:
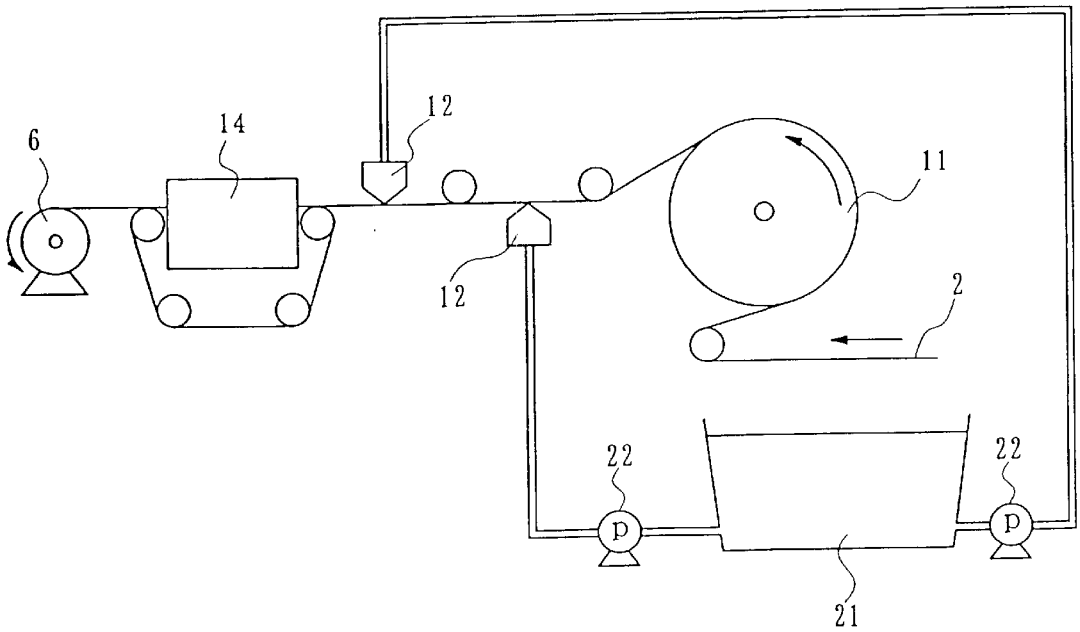
FIG. 7 is an explanatory view showing still another example of a step for coating a water soluble resin on both sides of a water-decomposable non-woven fabric.

Then, FIG. 5 to FIG. 7 are explanatory views, each showing a production process of the cleaning article 6 of FIG. 1(B) in which the solution of the water soluble resin is coated on both sides of the water-decomposable non-woven fabric 2.

The solution of the water soluble resin may be coated on both sides of the water-decomposable non-woven fabric 2 by repeating the process shown in FIG. 3 or FIG. 4. However, the solution of the water soluble resin can be coated easily on both sides of the water-decomposable non-woven fabric 2 in a short period of time by using the process shown in FIG. 5, FIG. 6 or FIG. 7.

In the process shown in FIG. 5, after the water-decomposable non-woven fabric 2 formed by a water jet treatment is dried by a drying drum 11, coaters 12, 12 are applied respectively one to each side of the water-decomposable non-woven fabric 2, and the solution of the water soluble resin delivered from pumps 22, 22 is coated on both sides of the water-decomposable non-woven fabric 2. The water-decomposable non-woven fabric 2 after the coating is brought into contact with a drying drum 13, by which the water soluble resin at the surface on one side thereof is dried. By disposing an auxiliary hot blow drier (auxiliary drier) 15 to the periphery of the drying drum 13, the water soluble resin at the surface on the side opposite to that contacted with the drying drum 13 is dried. Then, the resulting dried product is taken up as the cleaning article 6.

In the process shown in FIG. 6, the solution of the water soluble resin is coated by a coater 12 on one side of the water-decomposable non-woven fabric 2 after the drying step by a drying drum 11. Then, the surface coated with the solution of the water soluble resin is brought into contact with a succeeding drying drum 13 and the water soluble resin is dried. Subsequently, the solution of the water soluble resin is coated again on the other surface (opposite surface) of the water-decomposable non-woven fabric 2 by another coater 12 and the opposite surface coated immediately before is brought into contact with a succeeding drying drum 16, by which the water soluble resin on the opposite surface is dried. Then, the resulting dried product is taken up as the cleaning article 6.

The process shown in FIG. 7 is similar to that shown in FIG. 4. In this process, after the water-decomposable non-woven fabric 2 formed by a water jet treatment is dried by a drying drum 11, the solution of the water soluble resin is coated on both sides of the water-decomposable non-woven fabric 2 by coater 12, 12. Subsequently, the non-woven fabric 2 is sent to a hot blow drier 14 and the water soluble resin coated on both sides of the non-woven fabric 2 is dried.

EXAMPLES

The invention is described in more detail with reference to the following Examples, which, however, are not intended to restrict the scope of the invention.

(Blank)

As raw material fibers, 50% by weight of bleached soft-wood kraft pulp (NBKP) (Canadian Standard Freeness, CSF=740 ml) and 50% by weight of rayon fibers (manufactured by Toho Rayon Co.) having a fineness of 1.5 denier and a fiber length of 5 mm were used. They were processed at 0.2% concentration by a laboratory hand-papermaking machine to form a fiber web on a plastic wire. The fiber web has a size of 25 cm×25 cm and a basis weight of 40 g/m$^2$. Without being dried but still on the plastic wire, the resulting fiber web was put on a transfer conveyor. While being moved at a speed of 30 m/min, the fiber web was subjected to a water-jetting treatment, whereby the fibers constituting it were entangled. The high-pressure water-jetting device used for the treatment was equipped with 2000 nozzles/meter each having an orifice diameter of 95 microns, at intervals of 0.5 mm between the adjacent nozzles, and the pressure of the jetting water stream applied to the web was 30 kg/cm$^2$. In that condition, jetting water was applied to one surface of the web so that it passes through its back surface. The processing speed was 30 m/min. The water-jetting treatment was repeated once again under the same condition. Then, the fiber web was dried by using a drying drum to obtain a water-decomposable non-woven fabric 2.

Example 1

A water soluble resin was coated on one side of the water-decomposable non-woven fabric 2 for the blank described above by using a coater. The coated water soluble resin was alkyl cellulose and (meth)acrylic acid (ester) maleic acid copolymer dissolved in purified water. The concentration of the alkyl cellulose and (meth)acrylic acid (ester) maleic acid copolymer in purified water was 7.5% by weight and the mixing ratio of the alkyl cellulose and (meth)acrylic acid (ester) maleic acid copolymer was 5:1. The solution was used at a viscosity controlled to 30,000 cps and the coating amount only on one side of the non-woven fabric was 3.0 g/m$^2$ being converted as the water soluble resin in the dry state.

Example 2

The same water soluble resin as in Example 1 was coated on both sides of the non-woven fabric 2 for the blank described above by using a coater. The amount of coating was 1.5 g/m$^2$ for each side of the non-woven fabric and, thus, 3.0 g/m$^2$ for the total of both sides.

Comparative Example 1

The same water soluble resin as in Example 1 at a viscosity controlled to 300 cps was impregnated by 3.0 g/m$^2$ to the blank described above.

Comparative Example 2

The same water soluble resin as in Example 1 at a viscosity controlled to 300 cps was blown by spraying from one side at 3.0 g/m$^2$ to the blank described above.

(Chemical solution impregnated state)

Products of the blank, Example 1, Example 2, Comparative Example 1 and Comparative Example 2 were each impregnated with a chemical solution for test in a chemical solution impregnated state.

The chemical solution was impregnated by 250 g based on 100 g of the water-decomposable non-woven fabric by using a spray. The composition of the chemical solution was; sodium sulfate anhydride:trimethyl glycine:propylene glycol:purified water=4:4:10:82 by weight ratio.

(Test)

(1) Surface strength

The number of cycles till rounded fluffing occurred on the surface of the non-woven fabric (in a dry state) or breakage was caused on the surface of the non-woven fabric (in a chemical solution impregnated state) was measured according to JIS P 8136 by using a friction fastness tester.

(2) Softness

The bending rigidity for the characteristic item B was measured by using a KES tester (manufactured by Kato Tech Co.). In the KES test, the bending rigidity is higher as the B value is higher.

(3) Water decomposability

The test for the water decomposability was conducted based on a test for the looseness of toilet paper according to JIS P 4501. Referring specifically, a piece of the water-decomposable non-woven fabric cut into 10 cm length and 10 cm width was placed in a 300 ml volume beaker containing 300 ml of ion exchanged water and stirred by using a rotor. The number of rotation was 600 rpm. The condition of the test piece being dispersed in water was macroscopically observed, and the time until the test piece was finely dispersed was measured (unit:sec).

The surface strength, softness and water decomposability were measured both in the dry state and the chemical solution impregnated state for each of the blank, Example 1, Example 2, Comparative Example 1 and Comparative Example 2 respectively. The results are shown in the following Table 1.

TABLE 1

| | | | | Example | | Comp. Example | |
|---|---|---|---|---|---|---|---|
| | Coating condition | Coating method | Blank Not coated | 1 Coated on one side | 2 Coated both sides | 1 Impregnation coating | 2 spray coating |
| | Resin viscosity | (cps) | none | 30000 | 30000 | 300 | 300 |
| | Coating amount | (g/cm$^2$) | none | 3.0 | 3.0 (1.5:one side) | 3.0 | 3.0 |
| Dry state | Surface strength | cycles of friction | 7 | 50 or more | 50 or more | 38 | 25 |
| | Softness (KES) | Bending test, B value | 0.0278 | 0.0752 | 0.913 | 0.124 | 0.998 |
| | Water decomposability | sec | 15 | 27 | 32 | 30 | 30 |

TABLE 1-continued

| | | | | Example | | Comp. Example | |
|---|---|---|---|---|---|---|---|
| | Coating condition | Coating method | Blank Not coated | 1 Coated on one side | 2 Coated both sides | 1 Impregnation coating | 2 spray coating |
| Chemical solution impregnated state | Surface strength | cycles of friction | 1 | 24 | 16 | 9 | 7 |
| | Softness (KES) | Bending test, B value | 0.0233 | 0.0431 | 0.0512 | 0.0924 | 0.0754 |
| | Water decompos-ability | sec | 8 | 30 | 35 | 35 | 31 |

As can be seen from the Table above, the products obtained by practicing the invention, although being bulky and of low density, have higher surface strength compared with Comparative Examples 1 and 2. In addition, the softness was comparable with Comparative Examples 1 and 2 and, further, the water decomposability was also favorable.

As has been described above, the water-decomposable cleaning article according to the invention has higher surface strength, excellent softness and favorable water decomposability compared with existent articles.

While the invention has been described in detail and with reference to specific embodiments thereof, it will be apparent to one skilled in the art that various changes and modifications can be made therein without departing from the spirit and scope thereof.

What is claimed is:

1. A method of manufacturing a cleaning article comprising:

a step of subjecting a fiber web comprising water dispersible fibers to a water jetting treatment thereby forming a water-decomposable non-woven fabric;

a step of drying the water-decomposable non-woven fabric with a drying drum brought into contact with one surface thereof;

a step of coating a surface of the water-decomposable non-woven fabric, with a water soluble resin solution having a viscosity in the range of 10,000 to 70,000 cps; and a step of drying the coated water soluble resin solution, wherein the water soluble resin solution contains alkyl cellulose and a (meth)acrylic acid (ester) maleic acid copolymer.

2. A method of manufacturing a cleaning article according to claim 1, wherein said fiber web comprises pulp and rayon fibers.

3. A method of manufacturing a cleaning article according to claim 1, wherein the coated surface of the water-decomposable non-woven fabric is the surface brought into contact with the drying drum.

* * * * *

UNITED STATES PATENT AND TRADEMARK OFFICE

CERTIFICATE OF CORRECTION

PATENT NO. : 6,660,334 B2
DATED : December 9, 2003
INVENTOR(S) : Naohito Takeuchi et al.

It is certified that error appears in the above-identified patent and that said Letters Patent is hereby corrected as shown below:

Title page,
Item [75], Inventors, delete "Konishi Takayoshi" and substitute
-- Takayoshi Konishi --.

Signed and Sealed this

Twenty-seventh Day of April, 2004

JON W. DUDAS
*Acting Director of the United States Patent and Trademark Office*